United States Patent [19]

Anderson et al.

[11] 4,122,655

[45] Oct. 31, 1978

[54] HOUSING AND MOUNTING MEANS FOR OPEN END SPINNERS

[75] Inventors: Gordon C. Anderson, Clemson, S.C.; James W. B. Clayton, Accrington, England

[73] Assignee: Platt Saco Lowell Limited, Helmshore, England

[21] Appl. No.: 796,000

[22] Filed: May 11, 1977

[30] Foreign Application Priority Data

May 18, 1976 [GB] United Kingdom ..... 20372/76

[51] Int. Cl.[2] ..... D01H 1/12; D01H 1/16; D01H 1/28

[52] U.S. Cl. ..... 57/58.89; 57/58.95

[58] Field of Search ..... 57/56, 58.89–58.95

[56] References Cited

U.S. PATENT DOCUMENTS

| | | | |
|---|---|---|---|
| 3,756,007 | 9/1973 | Bartling | 57/58.91 |
| 3,774,382 | 11/1973 | Bartling | 57/58.89 X |
| 3,846,967 | 11/1974 | Braun | 57/58.89 X |
| 3,879,926 | 4/1975 | Bartling et al. | 57/58.95 |
| 3,911,660 | 10/1975 | Stalder | 57/58.89 |
| 3,922,840 | 12/1975 | Wanatabe et al. | 57/58.89 |
| 3,986,328 | 10/1976 | Harrap | 57/56 |

*Primary Examiner*—Charles Gorenstein
*Attorney, Agent, or Firm*—Donald H. Feldman

[57] ABSTRACT

A machine for the open-end spinning of yarns includes a machine frame which supports a plurality of side-by-side spinning units, each including a fibre opening roller and a spinning rotor, the arrangement being such that the rotational axes of the spinning rotors and opening rollers lie in respective first and second planes. The housings are mounted on the machine frame for pivotal movement about an axis transverse to the rotational axis of the spinning rotor and positioned between the first and second planes.

A catch for holding against pivotal movement additionally acts to hold a cover extending over the housing in place. A second cover, which may be transparent, lies beneath the first cover and separately covers the opening roller. The supporting brackets for the housings are arranged such that each housing can be readily removed from the machine frame.

4 Claims, 6 Drawing Figures

HOUSING AND MOUNTING MEANS FOR OPEN END SPINNERS

FIELD OF THE INVENTION

This invention relates to apparatus for open-end spinning textile yarns.

In known apparatus for open-end spinning textile yarns, a sliver is fed to a rotating opening roller which opens and combs the fibres in the sliver and transfers them to the entrance of a fibre feed duct. The fibres are conveyed in discrete form through the feed duct to a rotating spinning rotor where they accumulate on the internal fiber collecting surface thereof. The fibres are withdrawn from the fibre collecting surface by continuously twisting them into a tail end of yarn which is then conveyed to a winding device to form a package.

It is often necessary to gain access to the spinning rotor in order to perform a servicing procedure, such as, for example, cleaning the inside of the spinning rotor. The open top of the spinning rotor is normally closed by a cover member which, in the interests of safety, should not be removed whilst the rotor shaft is drivingly engaged by its driving means.

DESCRIPTION OF THE PRIOR ART

U.S. Pat. No. 3,756,007 discloses an open-end spinning unit comprising a housing rotatably supporting a spinning rotor and an opening roller each of which is fixed on one end of a respective driving shaft. At the other end of each shaft a pulley is fixed thereto for driving engagement with a respective driving belt. The rotational axes of the spinning rotor and the opening roller are parallel and lie in a common vertical plane. The housing is pivotally connected at its upper end to a machine frame for pivotal movement about an axis transverse to the rotational axes of the rotor and roller between an operative position in which the rotor and roller driving shafts are in driving connection with their respective driving belts and an inoperative position in which the rotor and roller driving shafts are disconnected from driving connection with their respective driving belts.

With the pivotal axis of the housing so positioned, the disengagement of the rotor and opening roller pulleys from their respective driving belts, as the housing moves from the operative position to the inoperative position, is not very positive, particularly the disengagement of the pulley positioned furthest from the pivotal axis. The disconnection of the pulleys from the driving belts takes place progressively across the width of the belts with the result that the latter is disadvantageously subject to uneven wear. Furthermore, the amounts of movement of the rotor pulley with respect to its driving belt and opening roller pulley with respect to its driving belt required to achieve complete disconnection therebetween are not the same, thus entailing a greater movement of the housing than is necessary.

German Offenlegungschrift as published on Apr. 4, 1975 No. 2,449,692 discloses a further open-end spinning unit in which facility is provided for gaining access to the spinning rotor. In this disclosure the units, when mounted side-by-side, are such that the rotational axes of the spinning rotors lie in a common horizontal plane. In order to gain access to the rotor with this type of configuration it has been necessary to provide separate housings for the spinning rotor and opening roller which, when moved to their inoperative positions, make a pivotal movement in opposite directions about a common pivot. The pivotal axis of the housings is positioned on a line extending from a point of intersection of the aforesaid vertical and horizontal planes and which line substantially bisects these planes.

Such a configuration, apart from not providing the best disposition of the spinning elements from a spinning technology aspect, inevitably leads to difficulties in making provision for safely gaining access to the spinning rotor.

SUMMARY OF THE INVENTION

It is an object of the invention to provide an open-end spinning station in which the housing thereof can be moved from an operative position, in which the spinning elements are driven in order to produce spun yarn, to an inoperative position, in which the spinning elements are not so driven and in which access to the rotor can be simply and safety achieved.

The invention provides apparatus for open-end spinning yarns comprising a machine frame upon which is mounted in side-by-side relationship a plurality of spinning stations; each spinning station includes a housing in which is a spinning rotor arranged for rotation about a first axis and an opening roller arranged for rotation about a second axis, the stations being arranged such that the first axes of the stations lie in a first plane and the second axes of the stations lie in a second plane spaced at the housing from said first plane, driving means for causing rotation of the spinning rotor and mounting means for mounting each housing for pivotal movement about a pivotal axis between an operative position, in which the driving means is in driving connection with the respective spinning rotor, and an inoperative position, in which the driving means is disconnected from driving connection with the spinning rotor, wherein the mounting means are arranged such that the pivotal axis of each housing extends transversely to the respective first axis and at a position intermediate said first and second planes.

DESCRIPTION OF THE PREFERRED EMBODIMENTS

A machine frame 1 extends longitudinally along the machine and comprises a plate which has at spaced intervals therealong apertures 2 each of which receives a spinning unit housing 3, which is substantially coextensive with the aperture and which extends forwardly and rearwardly of plate 1.

Figure 2:
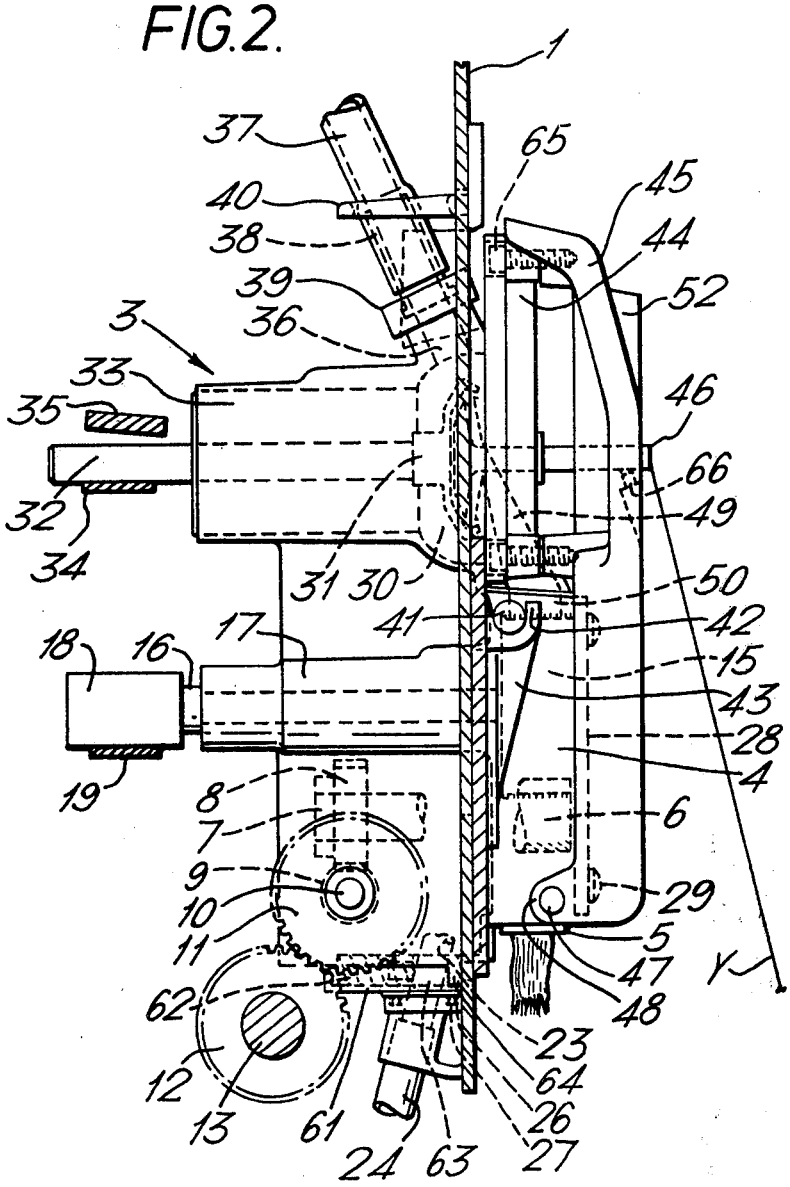
FIG. 2 is a cross-sectional side elevation on the line II—II of the spinning unit shown in FIG. 1.

Referring to FIG. 2, the housing 3 has a lower portion 4 protruding forwardly of the aperture 2 which serves to support a feed plate 5 resiliently biassed towards a rotatable sliver feed roller 6 to form therewith a sliver forwarding nip. The feed roller 6 is fixedly mounted on shaft 7 extending towards the rear of the housing and is supported in bearings (not shown) located in the housing. On the rear end of the shaft 7 is a gear wheel 8 having helical gear teeth around the periphery thereof arranged to be in mesh with a worm gear 9 machined in a countershaft 10 the axis of which extends transversely with respect to the rotational axis of shaft 7. An electromagnetic clutch (not shown) is mounted on the shaft 10 which can be actuated to start and stop rotation of the feed roller 6. Also mounted on the shaft 10 is a driven gear wheel 11 meshing with a driving gear wheel 12 fixedly mounted on a feed roller driving shaft 13. The shaft 13 extends along the machine and supports at spaced intervals therealong similar gear wheels 12 for effecting a drive to feed rollers at the remaining spinning units.

Figure 1:
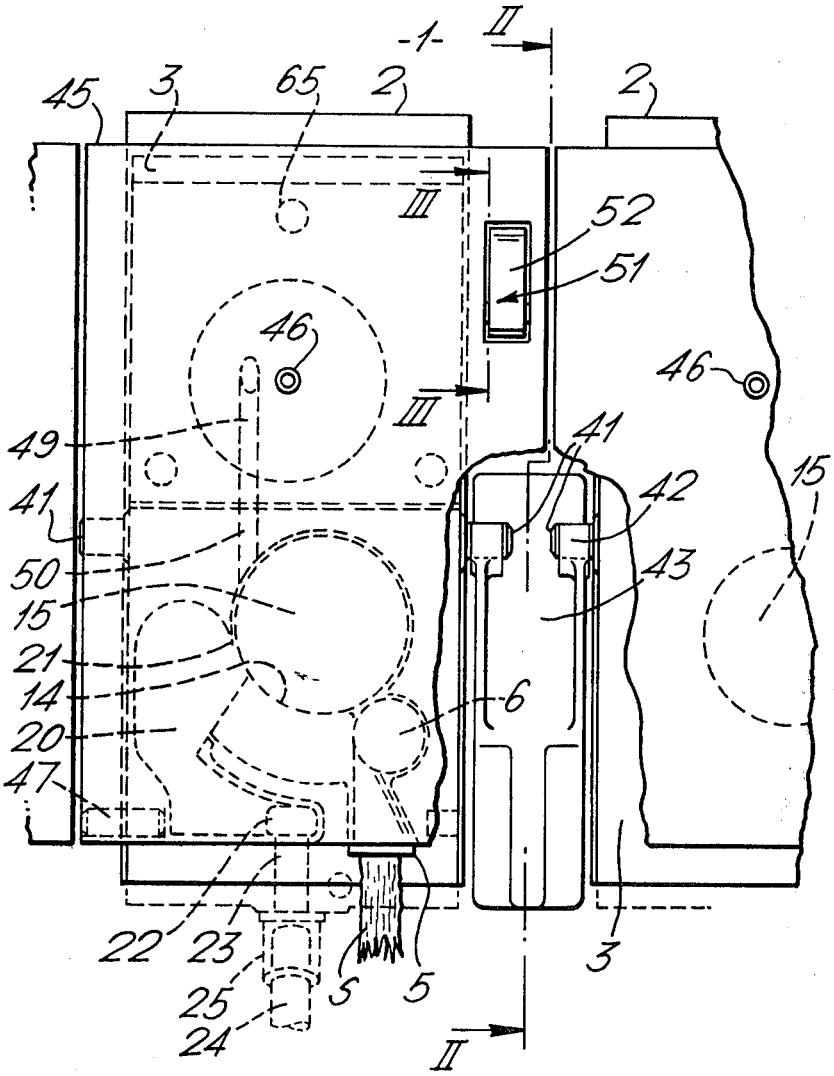
FIG. 1 is a front elevation of an open-end spinning unit according to the invention with a portion of the cover 45 cut-away in order to show more clearly the spinning unit supporting bracket 43.

As best seen in FiG. 1 the feed plate 5 has a curved fibre retaining surface 14 adjacent to the peripheral surface of an opening roller 15 which is housed for rotation in the lower portion 4 of the housing 3. The peripheral surface of the opening roller is provided with needles or saw-tooth wire for a purpose to be hereinafter described.

The opening roller 15 is fixedly mounted on a shaft 16 rotatably supported in bearings (not shown), which are located in a boss portion 17 for rotation about an axis parallel with the rotational axis of the feed roller supporting shaft.

The shaft 16 extends rearwardly out of the housing 3 and supports thereat a pulley 18 in driving engagement with a drive belt 19 which extends along the machine and serves to impart drive to similar opening rollers at the remaining spinning stations. The axes of rotation of the opening rollers lie in a common horizontal plane passing through the lower portion of the housings 3 when said housings are in their first or operable position.

Also provided in the lower housing portion 4 is a trash collection chamber 20 which communicates with the peripheral surface of the opening roller 15 by an aperture 21. At the bottom of the chamber 20 is an outlet 22 from which extends an outlet duct 23 formed in the housing 3 and movable therewith. The outlet duct 23 is arranged, with the housing in the position shown in FIG. 2, in alignment with the bore of a suction pipe 24 held in a bracket 25 fixed to the machine frame 1. In operation the suction pipe 24 is connected to a source of suction for a purpose hereinafter described. In the upper surface of the bracket 25 is an annular groove 26 which forms a seating for a rubber sealing ring 27.

A cover plate is fixed by screws 29 to the front face of the lower housing portion 4 in order to cover the feed plate 5, feed roller 6, opening roller 15 and trash collection chamber 20.

In the upper portion of the housing 3 a cavity 30 is formed to provide a chamber for a spinning rotor 31. The spinning rotor is fixedly mounted on a shaft 32 rotatably mounted in bearings (not shown) which are located in a boss portion 33. The shaft 32 extends rearwardly of the boss portion 33 and is drivingly engaged by a driving belt 34 extending along the machine and serving to drive the rotor shafts at the remaining spinning stations. The stations are arranged such that the axes of rotation of the rotors lie in a common horizontal plane passing through the upper portion of the housings 3 when said housings are in their first or operable position. A brake pad 35 is positioned adjacent the shaft 32 so as to apply a braking effect on the shaft 32 when in operative communication.

Communicating with the cavity 30 is a suction duct 36 which is connected to a source of suction by a flexible suction pipe 37. The suction pipe 37 is secured on a pipe connector 38 held in position by an adaptor 39 screwed on the housing 3. Encircling the pipe 37 is a locating ring 40 fixed to the machine frame 1.

The cavity 30 is closed by a closure member 44 attached to a cover 45 by three screws 65. The closure member 44 supports a yarn doffing tube 46 provided with a duct co-axial with the rotary axis of the spinning rotor 31. The doffing tube 46 extends through and protrudes from the front surface of the cover 45 in which it is secured by a screw 66.

The cover 45 is pivotally mounted at its lower end on pivot pins 47 which pass through bores formed in lugs 48 and into corresponding bores provided in the lower portion 4 of the housing 3.

Thus the cover 45 in its covering or closed position covers the rotor 31 and the chamber 30 and overlies parallely the separate cover 28. The pivot pins 47 enable the cover to be pivotted through approximately 90° to expose the parts previously covered and to enable, if required, removal of the separate cover 28. A fibre feed duct 49 is formed in the closure member 44 and provides a passage between a duct 50 in the lower portion 4 of the housing 3 and the interior of the spinning rotor 31.

Protruding from each side of the housing 3 is a trunnion 41 resting in a plastics journal bearing 42 which only partly surrounds the trunnion 41, of a support bracket 43 secured to the machine frame 1. As seen in FIG. 1, the support bracket 43 is positioned between the housings 3 of adjacent spinning units and has two bearings 42; one of which supports the right hand side of trunnion 41 of housing 3 and the other of which supports the left hand side trunnion 41 of the adjacent housing 3.

The trunnions 41 are free to rotate within the bearings 42 whereby the housings 3 can be pivotted about a horizontal pivotal axis passing through the trunnions 41 and lying transverse to the rotational axes of the opening roller and rotor and intermediate said axes and the aforementioned planes containing these axes. Although the pivotal axis is closer to the plane of the opening rollers, the distance between the pivotal axes and the two planes is of the same order of mangitude.

Figure 3:
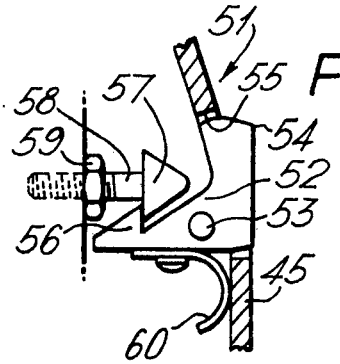
FIG. 3 is a cross-sectional side elevation on the line III—III of the spinning unit of FIG. 1 showing in detail the catch assembly 51.

The spinning unit assembly is retained in the operating position shown in FIG. 2 and the cover 45 is retained in the closed position by a catch assembly illustrated particularly in FIG. 3. A retaining member 52 is pivotally mounted on a pin 53 carried by the cover 45 and has a hand operable portion 54 protruding through an aperture 55 in the cover 45. A hook 56 on the retaining member 52 engages a head 57 of a catch 58 screwed into the machine frame 1 and located therein by a nut 59. The hook 56 is biassed into engagement with the head 57 by means of a spring 60 fixed to the underside of the retaining member 52 and so formed as to engage the inside surface of the cover 45 thus tending to rotate the retaining member 52 in a clockwise direction as seen in FIG. 3.

At the bottom of the housing 3 a blind hole is provided to receive a helical spring 62 and a piston 63. The spring 62 acts to force the piston 63 against the machine frame 1 thus tending to move the housing 3 in a clockwise direction about the trunnions 41 towards the inoperative position (not shown). This movement of the housing is prevented by engagement of the hook 56 with the head 57 of the catch 58. Thus positive retention of the housing 3 in the operative position shown in FIG. 2 is attained. Extending from the bottom of the housing is a lip 64 which engages the internal surface of the plate 1 behind the bottom surface of the aperture 2 to limit the extent of pivotal movement in an anticlockwise direction as shown in FIG. 2.

In operation with the housing in the operative position as shown in FIG. 2 a sliver S is forwarded between a nip formed between the sliver feed plate 5 and the rotating feed roller 6 to the opening action effected by the needles or teeth provided on the peripheral surface of the opening roller 15. During the opening action the fibres are constrained by the curved retaining surfce 14. At the termination of the retaining surface 14 considered in the direction of rotation as indicated by the arrow, the heavier impurities are ejected from the opening roller 15 through an aperture 21 to accumulate in the trash collection chamber 20.

Periodically, the chamber 20 is purged of impurities by applying suction to the pipe 24 so that the impurities are removed through the outlet 22, outlet duct 23 and the pipe 24 to be collected at a suitable location.

The fibres are conveyed by the opening roller 15 to the entrance of the duct 50 at which point they are removed from the roller 15 and are conveyed to the spinning rotor 31 down the duct 50 and the fibre feed duct 49. the fibres are conveyed along these ducts in an airstream derived from a suction source connected to the suction pipe 37 and accumulate on a fibre collecting surface formed at the maximum internal diameter of the spinning rotor. The fibres are removed from the spinning rotor 31 by twisting them into a tail end of spun yarn Y which is withdrawn through the doffing tube 46 by a pair of delivery rollers (not shown) and then formed into a package in the usual manner.

When it is required to gain access to the spinning rotor 31, for example following a yarn breakage, the hand operable portion 54 of the retaining member 52 is depressed. This causes movement of the retaining member 52 about the pin 53 so as to disengage the hook 56 from the head 57 of the catch 58. The pressure of the spring 62 reacts against the machine frame 1 through the piston 63 to pivot the housing 3 and the trunnions 41 in the bearings 42 in a clockwise direction about the pivotal axis from the operative position as seen in FIG. 2 to an inoperative position.

As the housing 3 pivots, the pulley 18 is disengaged from the driving belt 19 thereby disconnecting the drive to the opening roller 15. Simultaneously the drive to the spinning rotor 31 is disconnected by disengagement of shaft 32 from the driving belt 34, The shaft 32 is braked as it comes into engagement with the brake shoe 35.

Figure 4:
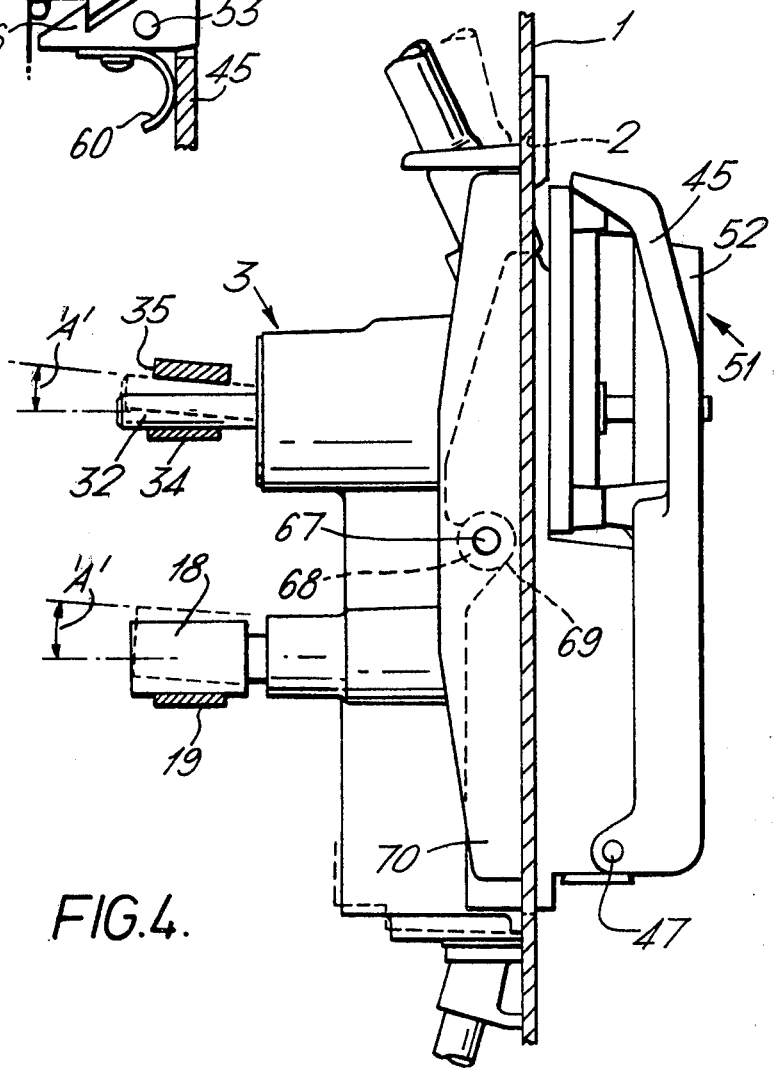
FIG. 4 is a cross-sectional side elevation of a spinning unit in accordance with a second embodiment of the invention.

The positions of the rotor shaft 32 and the opening roller pulley 18 when in the inoperative position of the housing 3 are indicated in broken line for convenience in the embodiment shown in FIG. 4. It will be seen that the amount of angular movement indicated by the angle 'A' of the rotational axes of the opening roller and spinning rotor before the motion is arrested by engagement of the shaft 32 with the brake shoe 35 is the same, or substantially the same. In practice, angle 'A' is in the region of 5°. It will further be appreciated that this arrangement provides a movement of both the rotational axes of the spinning rotor and opening roller which is substantially transverse to the respective driving belts thus providing a positive, immediate and simultaneous disconnection of the driving effect.

The feed roller 6 is stopped by actuation of the electromagnetic cluth on countershaft 10, but the slight pivotal movement of the housing 3 is insufficient to cause complete disengagement of the drive gear wheel 11 from the driving gear wheel 12.

In the inoperative position the cover 45, although maintained in covering position by friction in the pivot pins 47, together with the closure member 44 can be pivoted about the pivot pins 47 so that the inside of the spinning rotor 31 and the cavity 30 are exposed for maintenance or for such other purpose. If it is further required to gain access to the opening roller 15 feed roller 6, feed plate 5 or trash collection chamber 20 the cover plate 28 can be removed after withdrawal of screws 29.

If it is desired to remove the complete spinning unit from the machine it is possible in the inoperative position to unscrew the adaptor 39 thereby disconnecting the pipe 37 and the pipe connector 38 from the housing 3. The unit can then be lifted until the trunnions 41 are above the bearings 42 of the support bracket 43 whereupon the unit can be removed forwardly from the machine.

By positioning the pivotal axis of the housing intermediate the rotational axes of the spinning rotor and the opening roller the degree of movement required by the housing to disconnect the drives to the opening roller and spinning rotor is quite small. This is because the linear displacements of their axes caused by the small amount of angular movement of the opening roller shaft axis and spinning rotor shaft axis from the operative position to the inoperative position is the same or substantially the same in both cases.

Furthermore, the arrangement permits ready and safe access to the spinning rotor and the removal of a spinning unit from the machine is readily achieved.

Turning to the embodiment shown in FIGS. 4 and 5, the apparatus shown is substantially the same as that shown in FIGS. 1, 2 and 3 and only the differences will be described in detail. Specifically, a flange 70 is provided at each side of each aperture 2 and extends rearwardly from the machine frame plate 1. Each flange 70 fixedly supports a fulcrum pin 67 on which is rotatably mounted a plastics bearing bush 68. In each housing a supporting collar 69 is integrally formed at a side portion for receiving the bush 68. The collar 69 is open at the bottom and rear to readily receive the bush 69 and provides a support partly surrounding the bush 68 of the same diameter.

The spinning unit housing 3 is mounted on the machine frame 1 by insertion of the rear portion through the aperture 2 and guiding the bush so as to pass through the opening of the collar 69. The housing 3 is then pivoted in an anti-clockwise direction as viewed in FIG. 4 to the operating position in which it is retained against the reaction of the spring 62 by the engagement of the hook 56 with the head 57 of the catch 58.

Figure 5:
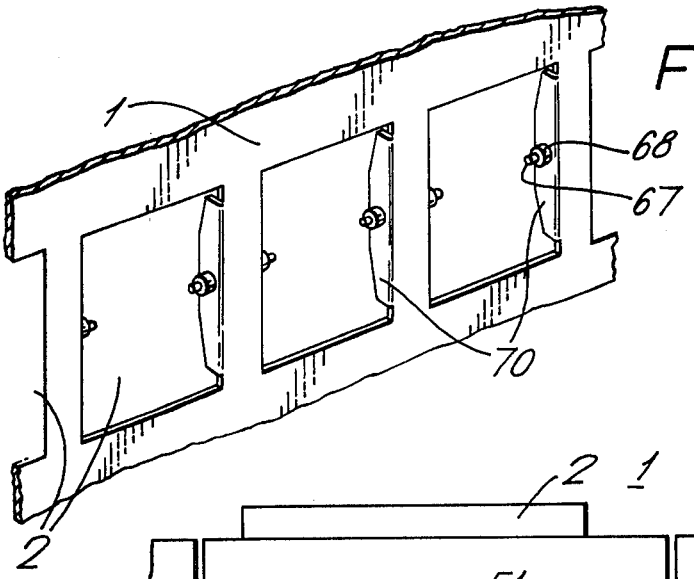
FIG. 5 is a perspective part front elevation of the embodiment shown in FIG. 4 with the spinning units removed.
Figure 6:
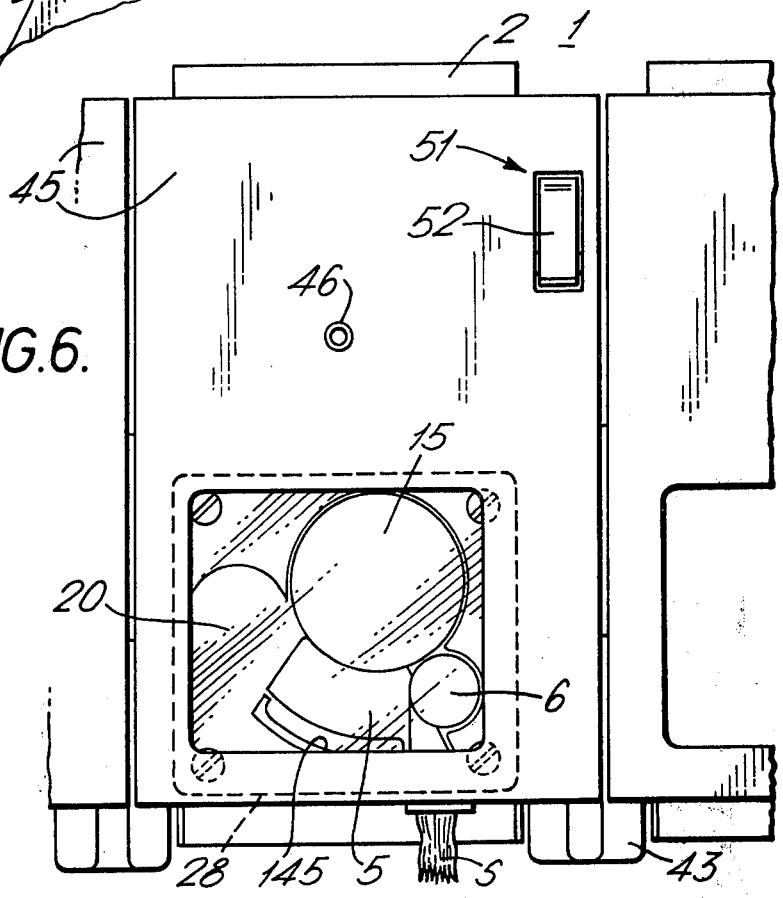
FIG. 6 is a front elevation of the spinning units of either FIG. 1 or FIG. 4 with the covers 45 and 28 modified.

Turning now to FIG. 6, the spinning units shown are substantially the same as that shown in FIGS. 1, 2 or 3 or as modified as shown in FIG. 4 and 5. Specifically this embodiment differs in that the cover 28 is formed of a transparent material and an aperture 145 is provided in the cover 45 which overlies the majority of the cover 28 so as to expose to view the feed roller 6, the feed plate 5, the trash collection chamber 20 and the opening roller 15.

We claim:

1. In an open end yarn spinning machine comprising a frame, a plurality of side-by-side yarn spinning stations fixed to and spaced along said frame, each of said stations including a housing, a yarn spinning rotor fixed to a shaft defining an axis therefor and for rotation thereabout and fixed to said housing for pivotal movement therewithin, a rotor drive means for rotating said rotor and its shaft in the spinning of yarn and being detachably interconnectable therewith, a fiber separating and opening roller fixed to a shaft defining an axis therefor and for rotation thereabout and fixed to said housing for pivotal movement therewithin, a roller drive means for rotating said roller and its shaft in the separation of fibers into discrete entities for conduction to said rotor and being detachably interconnectable therewith, and housing mounting means for supportively mounting said housing on said frame for pivotal movement between a first operable position wherein said rotor and roller and their shafts are drivingly interconnected to their respective drive means and a second inoperable position wherein said rotor and roller and their shafts are operably detached and disconnected from their respective drive means, said housing mounting means including support elements carried in part by said housing and said frame, said elements defining an axis for said pivotal movement of said housing and elements fixed thereto between said first and second positions, said housing further including therewithin a fiber feed roller and an interconnected driving shaft defining an axis therefor, said interconnected driving shaft being fixed to said housing and interconnected with a feed roller drive means for continuous rotation of said driving shaft during operation of said machine, the improvement wherein said driving shaft axis extends parallel to said housing pivotal axis.

2. The improvement as in claim 1, wherein said housing further includes an openable cover pivotally mounted on said housing for movement between a closed position wherein said cover covers said fixed elements within said housing and an open position wherein said fixed elements are exposed, and a second cover mounted between said openable cover and at least one of said fixed elements within said housing.

3. The improvement as in claim 2, wherein said second cover is transparent at least in part, and said openable cover is formed with an aperture extending at least in part over said second cover whereby to expose to view said part within said housing covered by said second cover when said openable cover is in its closed position.

4. The improvement as in claim 2, wherein there is further provided a catch assembly means carried in part by said frame and in part by said openable cover for releasably holding said housing in its said first position and said openable cover in its said closed position and for releasing said housing for pivoting to its said second position and said openable cover for pivoting to its said open position.

* * * * *